United States Patent [19]

Gentric

[11] Patent Number: 4,550,971

[45] Date of Patent: Nov. 5, 1985

[54] CONNECTOR

[76] Inventor: Alain Gentric, Lotissement Keranroux Ploubezre, F-22300 Lannion, France

[21] Appl. No.: 450,363

[22] Filed: Dec. 16, 1982

[30] Foreign Application Priority Data

Dec. 29, 1981 [FR] France ..... 81 24643

[51] Int. Cl.[4] ..... H01R 4/02

[52] U.S. Cl. ..... 339/99 R; 339/196 M

[58] Field of Search ..... 339/97 R, 97 P, 98, 339/99 R, 196 M, 210 M

[56] References Cited

U.S. PATENT DOCUMENTS

| | | | |
|---|---|---|---|
| 3,576,518 | 4/1971 | Bazille, Jr. et al. | 339/98 |
| 3,899,236 | 8/1975 | Santos | 339/98 |
| 3,993,391 | 11/1976 | Vernerey et al. | 339/97 R |
| 4,040,703 | 8/1977 | Shaffer et al. | 339/99 R |
| 4,062,615 | 12/1977 | Navarro | 339/98 |
| 4,153,326 | 5/1979 | Frantz et al. | 339/99 R |
| 4,225,205 | 9/1980 | Sinclair et al. | 339/98 |
| 4,426,125 | 1/1984 | Crawford | 339/99 R |

*Primary Examiner*—Gil Weidenfeld
*Assistant Examiner*—Gary F. Paumen
*Attorney, Agent, or Firm*—Laff, Whitesel, Conte & Saret

[57] ABSTRACT

A coupling connector has metallic contacts for separately securing insulated conductors. The connector base comprises two half-shells joined by a hinge. At least one of the half-shells comprises a row of plug-supports. At least the rear part of each plug-support has a U-shaped cross section. The other half-shell comprises a row of wire clamping U-shaped grooves, each having a longitudinal axis which is parallel to the axis of a corresponding one of the supports. Each U-shaped groove is in the axis of one plug-support when the two half-shells are closed one on the other, by pivoting around the hinge. Each of a pair of spears is symmetrically positioned with respect to the longitudinal axis of the groove. The half-shell has a row of holes behind the plug-supports. The spear pairs on the other half-shell hook to the holes when the two half-shells are closed.

2 Claims, 10 Drawing Figures

CONNECTOR

Figure 1:
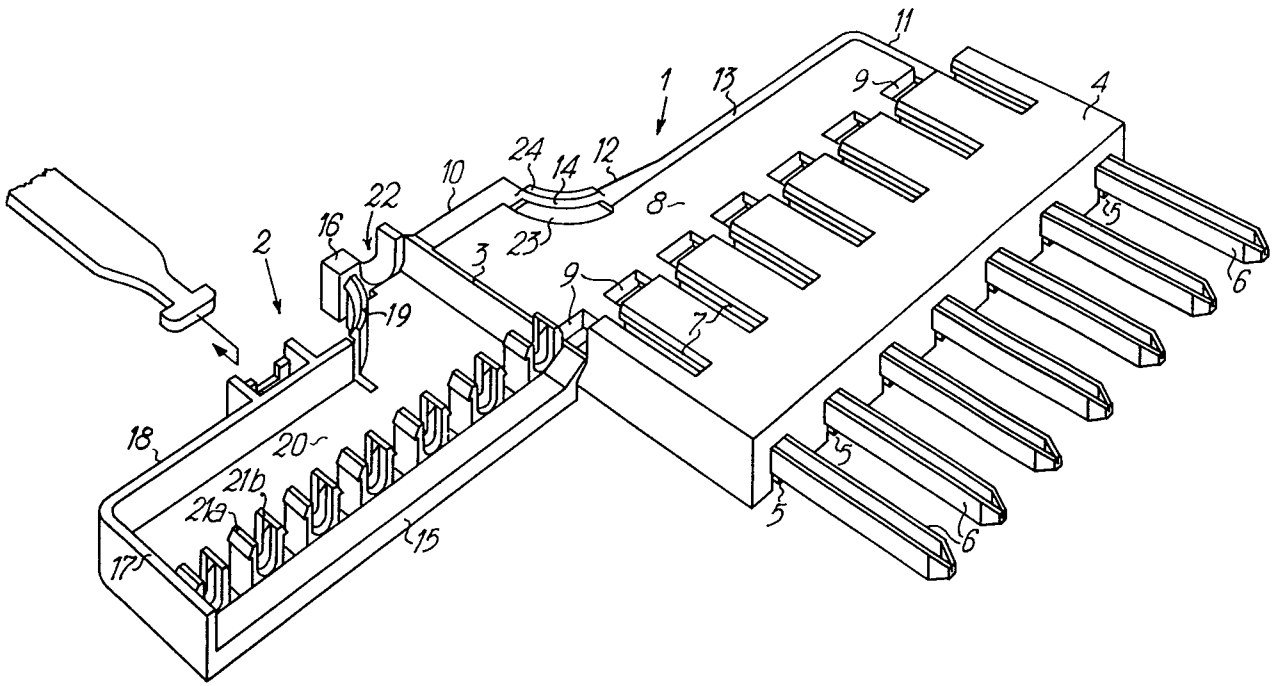

The present invention relates to coupling connectors comprising metallic contacts, wherein wires or insulated conductors are separately secured.

In the known connectors for wire bundles, the wires are passed through corresponding holes from the back of the base or the casing, and then electrically connected to the male or female plugs of the connector, the plugs having been passed through from the front part. The present invention relates to the base of a connector in which the wires are not passed through, but simply arranged in the base in such a way that the position of the wires may be visually controlled at a glance when the arrangement thereof is completed.

Practically, the description is made for self-stripping connection plugs which are actually on sale, and particularly the plugs sold by the French companies SOCAPEX and SOURIAU. By way of example, the cross-section of said plugs is U-shaped with two narrowed parts of the width of the U, so that, when a wire is aligned above the groove and then pushed back into said groove through the use of a separate tool, one of the narrowed parts partly cuts the insulating material for maintaining the wire, while the other cuts all the insulating material and partly the copper for establishing the electrical connection between the plug and the conductor of the wire. Practically, the connector casings which are intended for containing such plugs are provided with side apertures giving access to the wires with the tool.

In the U.S. patent applications Ser. Nos. 174,790 filed on Aug. 4, 1981 and 251,201 filed on June 4, 1981, assigned to the French government, a number of switches are described which are comprised of several layers of crosspoints and may be used in particular in distribution frames of telephone exchanges. The switches have the advantage of being controllable by robots and of being small-sized with respect of the conventional main distribution frames. Such a reduction in size goes with a greater density, particularly in the embodiments described in the second hereabove mentioned U.S. patent application, involving two imbricated or overlapping matrixes. Particularly, such a density of connections does no longer allow the use of conventional cable clips and cable paths.

A purpose of the present invention is to provide a connector base which overcomes the above mentioned difficulties.

The connection base according to this invention comprises two half-bases joined by a hinge, at least one of the half-bases comprising a row of plug supports. Each of the plug supports has a U-shaped cross-section, at least, at its back portion. The other half-base comprises a row of U-shaped groove wire clamping means having a longitudinal axis that is parallel to the one of the plug-supports, but a transversal location that is at the rear of the plane of the rear faces of the plug-supports. Each U-shaped groove wire clamping means is aligned with the axis of one plug-support when the two half-bases are closed one on the other, around the hinge.

According to another feature of this invention, each U-shaped groove means is made of two spears which are symmetrical with respect to the longitudinal axis of the means.

According to another feature of the invention, the half-base with the row of plug-supports is provided with a row of holes behind said plug-supports, the spear pairs of the other half-base being intended to hook into the holes, respectively, when the two half-bases are closed one on the other.

According to another feature of the invention, each half-base is provided with a row of plug-supports separated by free intervals which are equal to their width. A row of U-shaped groove wire clamping means are respectively located behind the intervals, so that the plug-supports rows and the groove means rows of the half-bases are imbricated or overlapped when the half-bases are closed one on the other.

Figure 2:
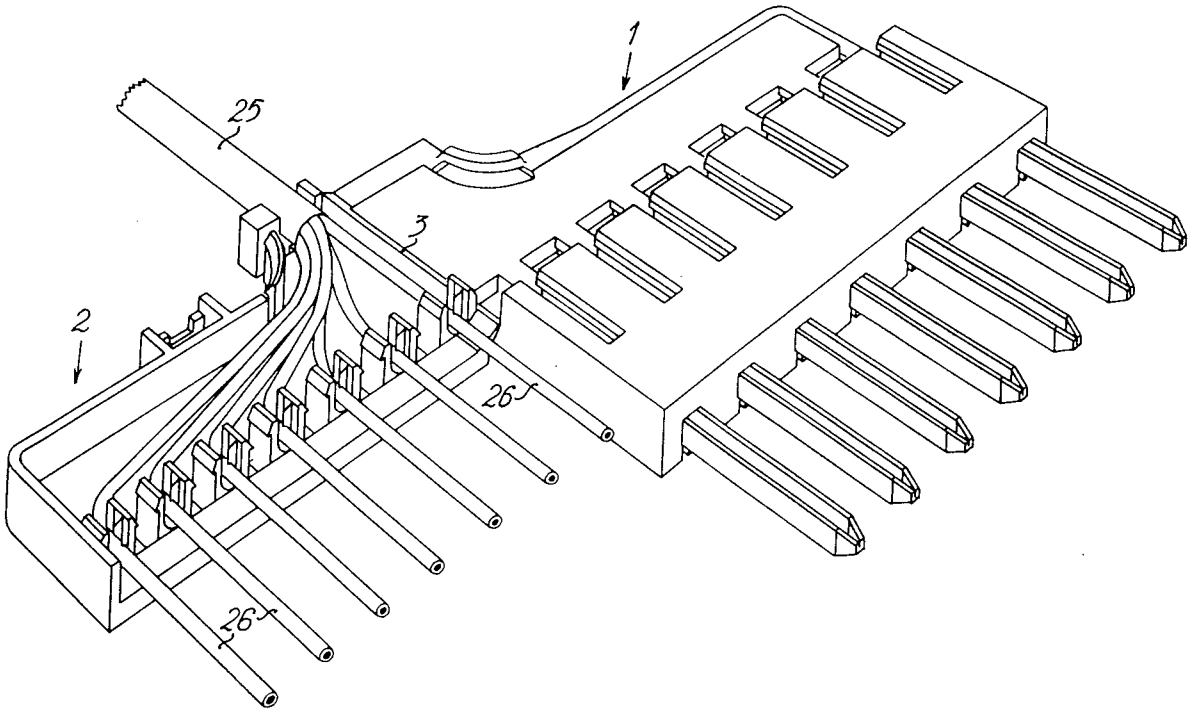
Figure 3:
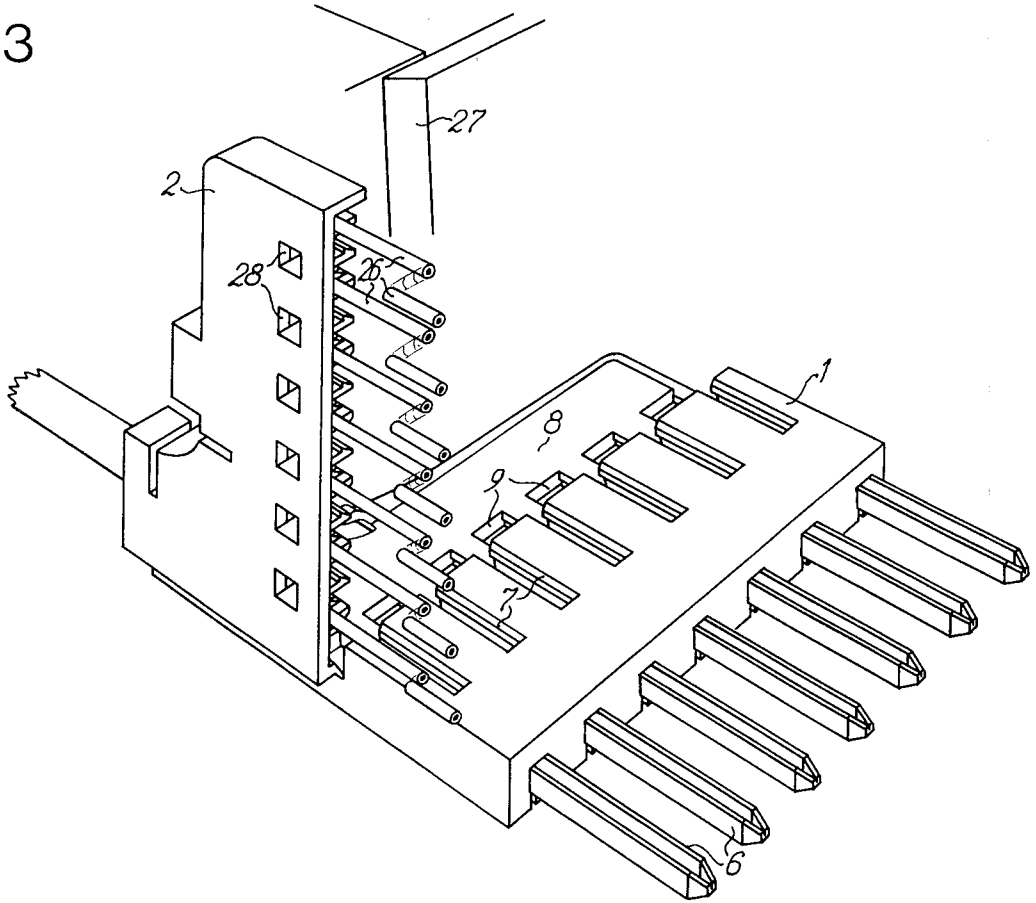
Figure 4:
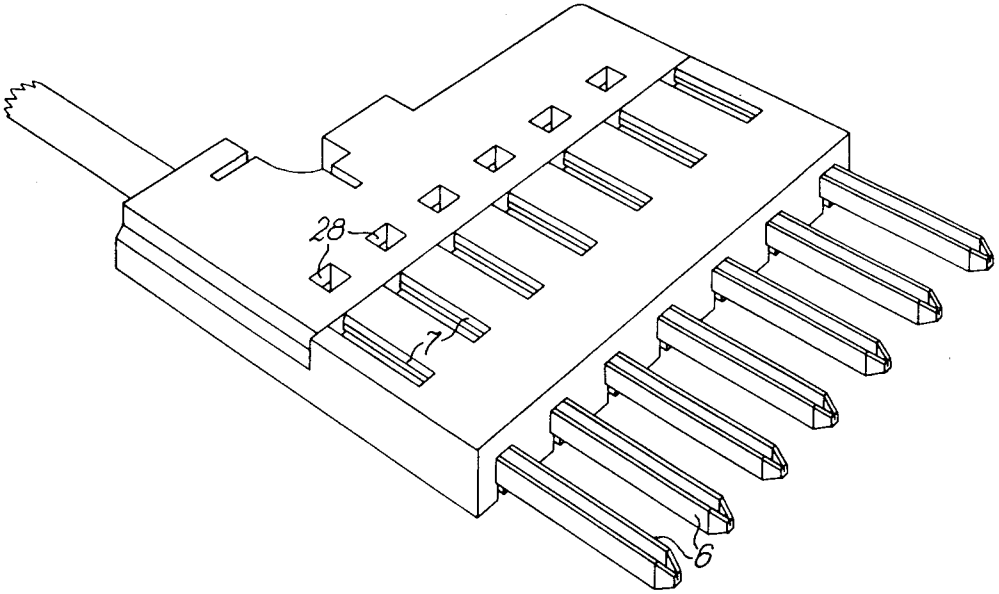
Figure 5:
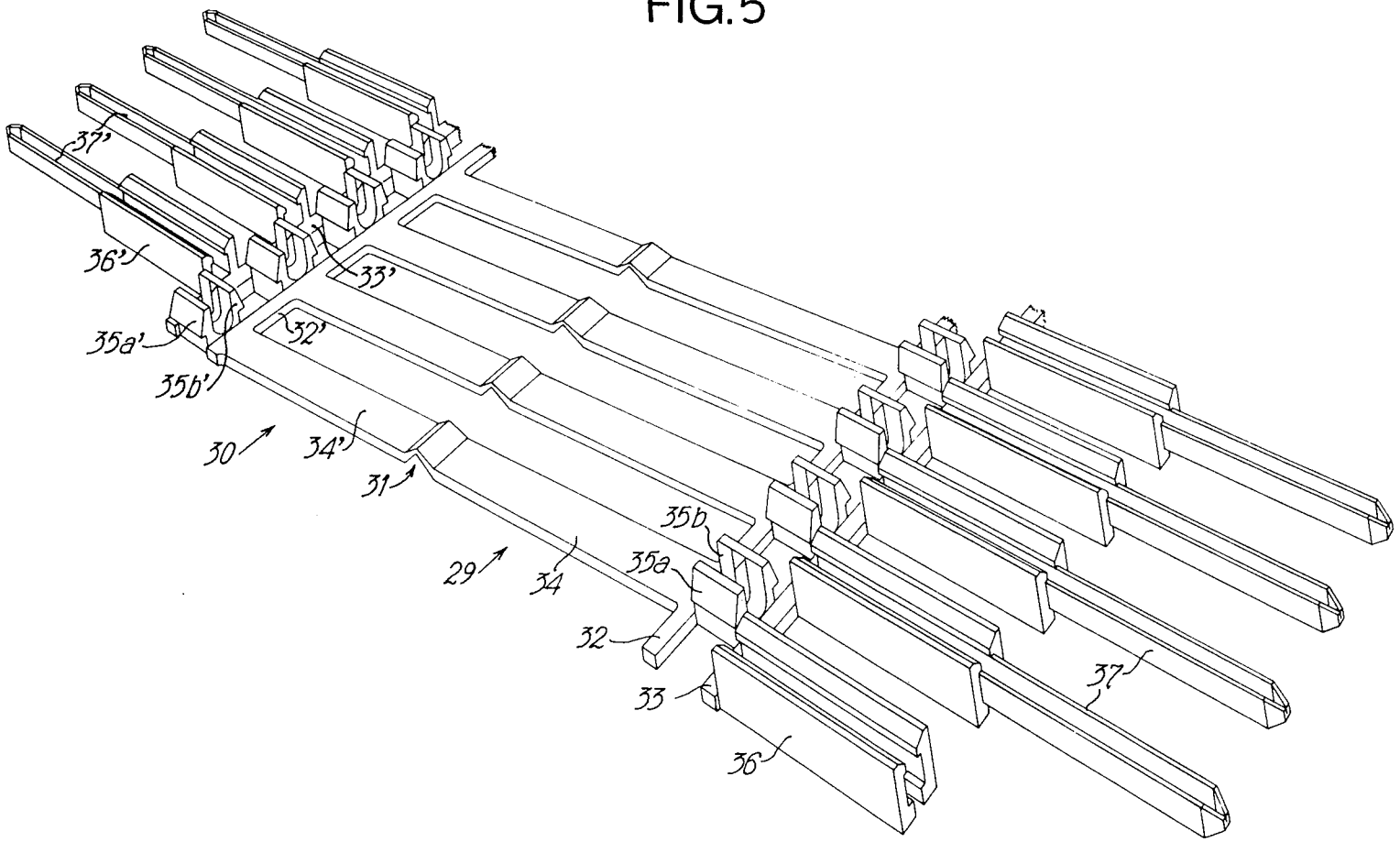
Figure 6:
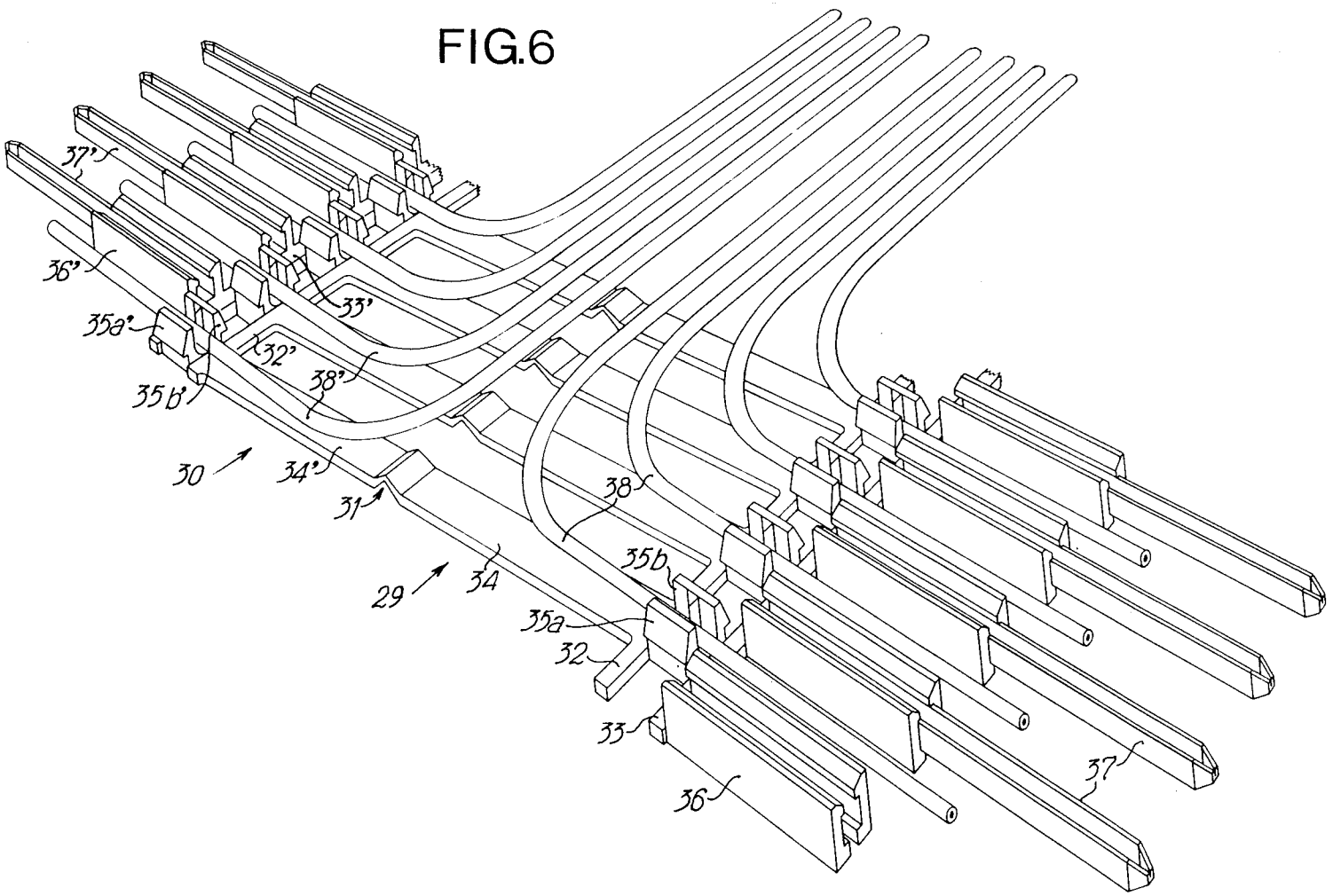
Figure 7:
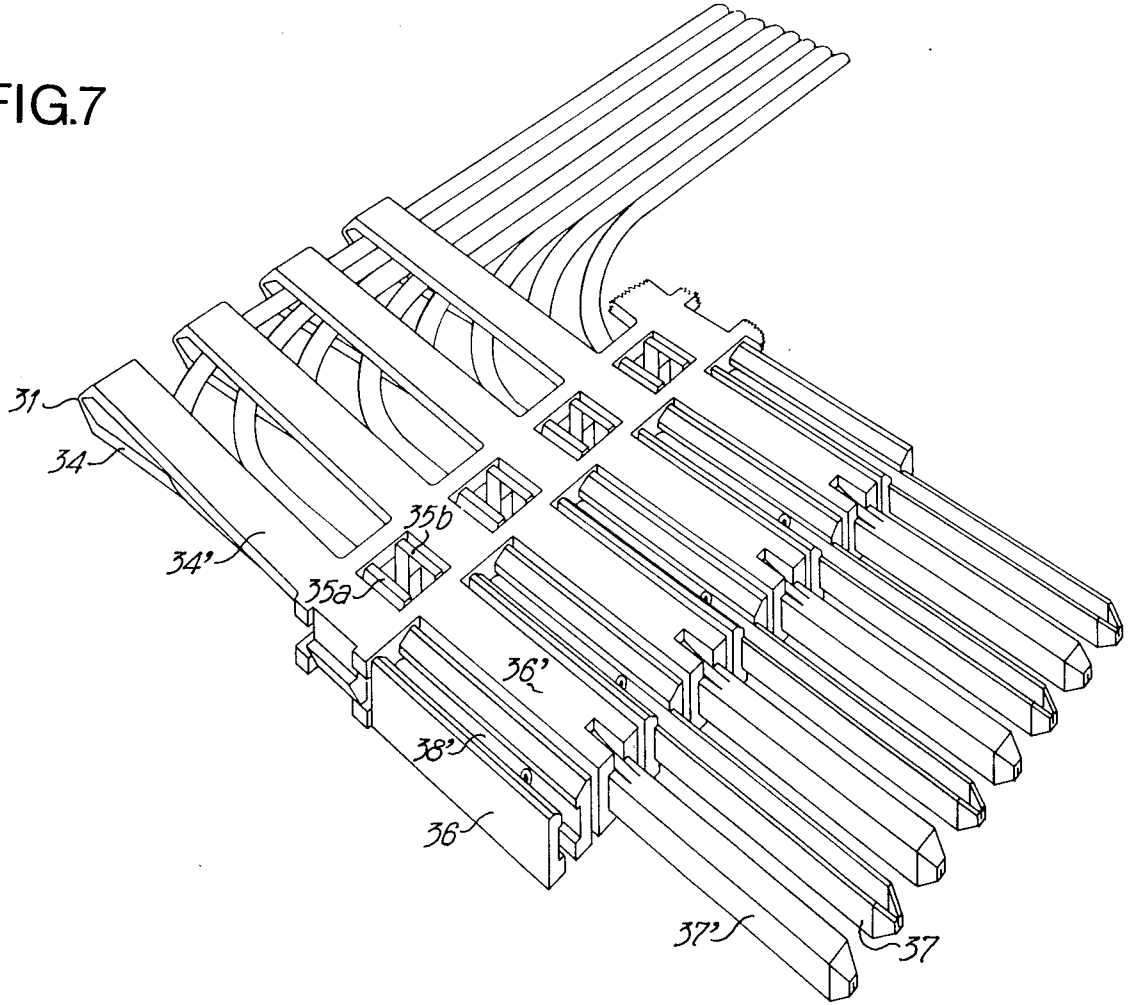
Figure 8:
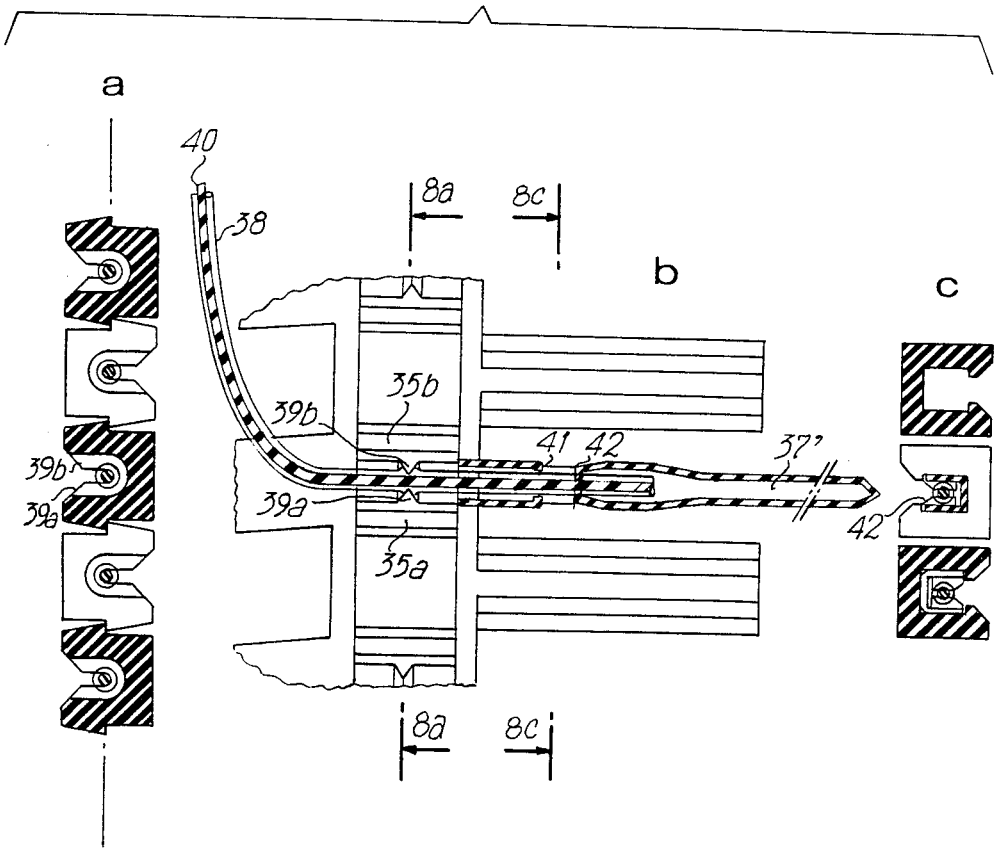
Figure 9:
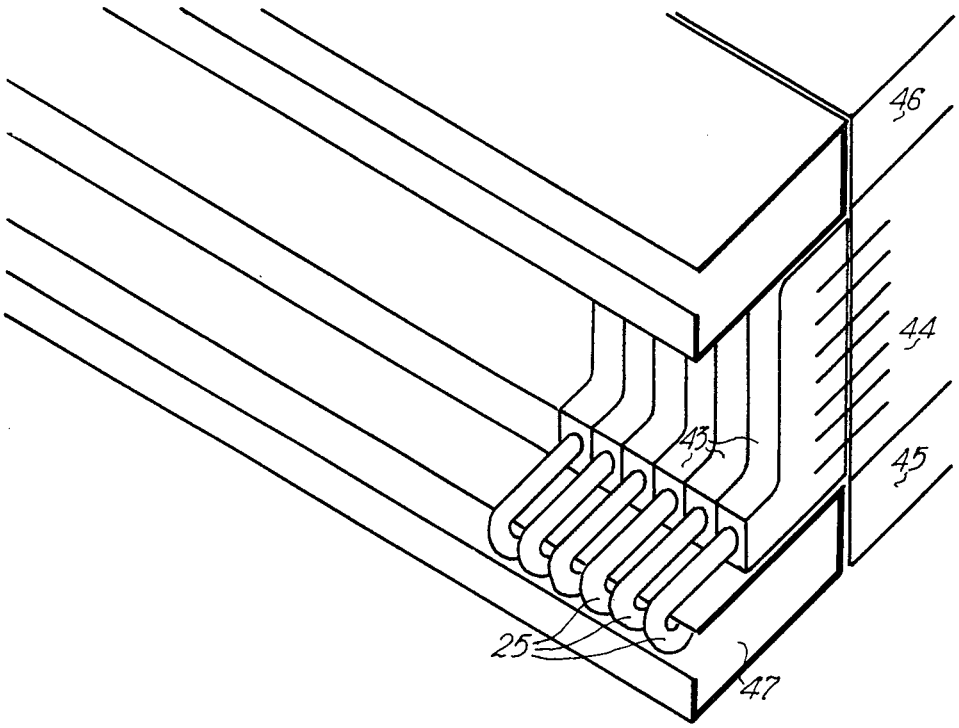
Figure 10:
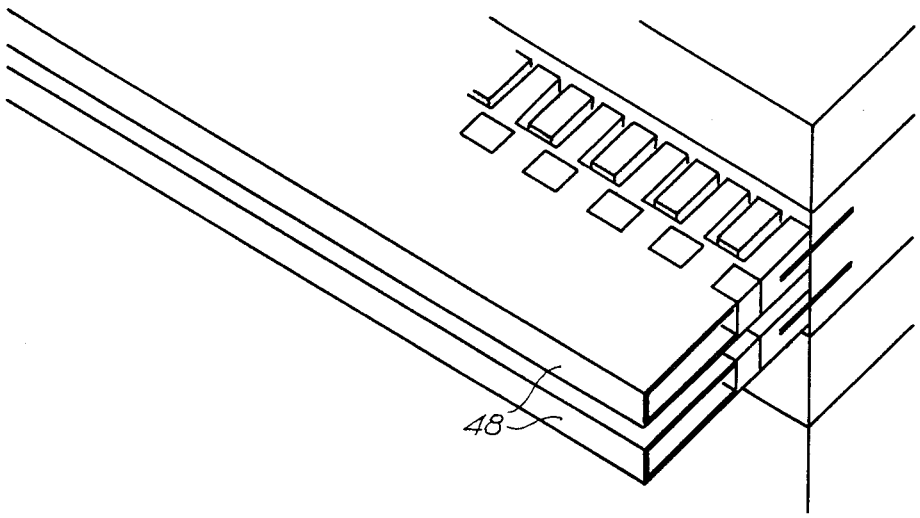

The above mentioned and other features of the invention will appear more clearly from the following description of embodiments, the description being made in conjunction with the accompanying drawings, wherein:

FIG. 1 is a perspective view of a first embodiment for a connector base according to this invention, FIG. 2 is a perspective view of the connector base shown in FIG. 1, wherein the connecting wires have been set, FIG. 3 is a perspective view of the connector base shown in FIG. 1, the connector base being in the process of closing, FIG. 4 is a view of the connector base shown in FIG. 3, when the connector base has been completely closed, FIG. 5 is a perspective view of a second embodiment according to this invention, the connector base being opened and merely provided with connecting plugs, FIG. 6 is a perspective view of the connector base shown in FIG. 5, wherein the connecting wires have been set, FIG. 7 is a view of the connector base, shown in FIG. 6, closed up, FIGS. 8*a*–8*c* are partial views in plane and in a cross section for illustrating the operation of the connector bases shown in FIGS. 1 and 5. More particularly, FIG. 8*b* is a plan view looking down on top of the connector base, and FIGS. 8*a* and 8*c* are cross sectional views taken along lines 8*a*—8*a* and 8*c*—8*c*, respectively, of FIG. 8*b*, FIG. 9 is a schematic view illustrating an application of the connector base shown in FIG. 1, and FIG. 10 is a schematic view illustrating an application of the connector base shown in FIG. 5.

The connector base of the FIG. 1 is made of two half-shells 1 and 2 jointed by a hinge 3. The front part 4 of the half-shell 1 corresponds to the front part of the body of a conventional connector and is provided with front-opened cavities 5 wherein the plugs 6 are inserted. In the described embodiment, the plugs 6 are self-stripping plugs. To this end, the upper wall of the front part or plug-support 4 of the half-shell 1 is provided with elongated apertures 7 straight above the plugs 6.

The rear part of the half-shell 1 is made of a flat bottom 8 which is in the same plane as the bottom of the front part 4. The bottom 8 is provided with a row of square holes 9 in front of the rear end of each plug 6. When seen from above, the surface 8 has somewhat the shape of a lyre of which the greater height is adjacent to the rear face of the plug-support part 4. The upper part is formed with one part of the hinge 3. The smaller height is perpendicular to the hinge, and the bottom part 11 is aligned with the outer face of the part 4. Between the small height 10 and the bottom part 11 is a generally concave shaped portion. In the described embodiment, the concave portion 12 comprises a rectilinear portion 13, which is perpendicular to portion 11, and extends in an arc portion 14.

The elongated apertures 7 extend up to the rear face of the plug-support part 4. Therefore, each of them is U-shaped when seen from above.

Seen from above, the half-shell 2 has the shape of a lyre, the shape being symmetrical with the bottom 8 of the other half-shell 1. Thus, its great height 15 is in the same plane as the rear face of the plug-support part 4. The upper part of the lyre is formed with the other part of the hinge 3. The small height 16 is aligned with part 10 and the bottom part 17 is symmetrical of the bottom part 11. The parts 16 and 17 are joined by a concave portion that is symmetrical with part 12 and comprises a rectilinear portion 18 and an arc portion 19.

A plurality of spears are arranged in pairs 21*a*, 21*b*, and form a row aligned with the row which is of holes 9. The spears 21 project from the bottom 20 of the half-shell 2. Each spear pair 21*a*, 21*b* corresponds to one of the holes 9 and enters the hole when the half-shell 2 is closed onto the half-shell 1, around the hinge 3. Practically, as shown in FIG. 1, the middle line of the row of holes 9 coincides with the middle line of the row of spears and is at such a distance behind the rear face of the plug-support part 4, that the front edges of the holes 9 stand back spaced from the rear face. A groove is formed between the spears of each spear pair, the longitudinal axis of the groove being parallel to the hinge 3.

The outer edges of the bottom 8 are at a lower level than the level of its central parts, in order to form a recessed edge. On the contrary, the outer edges of the bottom 20 are at a higher level than its central part, in order to form a raised edge, the raised edge being received in the recessed edge of the bottom 8, when the connector is closed.

More particularly, the raised edge of the part 16 is cut in order to form a groove 22, the longitudinal axis of which is parallel to the hinge 3. The raised edge of the arc 14 is not quite flat, but has a bevelled area 23 extending towards the center of the bottom 8 and a small raised edge 24 on its outer edge. The edge of the arc portion 19 on the other half-shell 2 has its outer raised edge bevelled towards the inner part of said half-shell. Therefore, the upper part of the raised edge of 19 dove tails behind the raised edge 24 when the connector is closed.

As shown in FIG. 2, to couple a seven insulated wire cable 25, the cable 25 is inserted into the groove 22. Then the cable sheath is cut in order to free the wires 26 which are separately arranged between the spears 21*a* and 21*b* of the corresponding pairs, according to a predetermined order. The wires are lying on the bottom the half-shell 2 between the groove 22 and the spears 21*a*, 21*b*.

A tool 27 is schematically shown in FIG. 3, the tool being intended to cut the wires 26 at the correct length when the half-shell 2 is turned a quarter turn towards the half-shell 1. The lengths of the wires 26 which extend beyond the spears 21*a*, 21*b* are thus cut at the same length. Practically, the ends of the cut wires 26 allow the wires to enter into the apertures 7 of the plug-support part 4 of the connector, when the half-shell 2 is completely closed on the half-shell 1, FIG. 4. A tool may be used either when the connector is closed or later on, in order to push the wires 26 towards the bottoms of the apertures 7, i.e. towards the bottom of the rear part of the plugs 6, where the wires are maintained and stripped in a conventional manner.

On the other hand, the points of the spears 21*a*, 21*b* have been inserted into their respective holes 9 and are now hooked under the bottom 8, so that the connector is thus locked.

As shown in FIGS. 3 and 4, holes 28 are provided under the grooves defined by the spears 21*a*, 21*b*. In practice, these holes are only provided for technological moulding requirements.

The connector base shown in FIG. 5 comprises two half-shells 29 and 30 which are joined by a hinge 31. The half-shell 29 comprises two parallel bars 32 and 33. The bar 32 is coupled to one part of the hinge 31 via the bands 34, the number of which is equal to the number of the plugs 37 supported by said half-shell. The bands 34 are not quite perpendicular to the hinge 31, but are oriented at a small angle with respect to the perpendicular of the hinge, such an angle corresponding to one half-pitch of the connector. Spear pairs 35*a*, 35*b* are provided between the bars 32 and 33, and in front of the bands 34. The spear pairs define a number of grooves perpendicular to the bars. Beyond the bar 33, parallel to the grooves of the spear pairs 35*a*, 35*b*, provided are separate plug-supports 36 which form a single unit with the bar 33. The plug-supports 36 are shown in FIG. 5 with the plugs 37 mounted therein. In the described embodiment, the plugs 37 are self-stripping plugs. The plug-supports have U-shaped cross-sections with an open upper part and have the raised edges and eventually the holes (not shown) necessary for maintaining the plugs 37 in their respective housings.

The axis of each plug-support 36 coincides with the middle of the respective spear-pair 35*a*, 35*b*.

The half-shell 30 is practically symmetrical with the half-shell 29. It comprises the bands 34' which are aligned with the bands 34. Two bars 32' are parallel to the bars 32 and 33 with the bar 31' integral with the ends of the bands 34'. Spear pairs 35*a'*, 35*b'* are mounted between the bars 32' and 33' in front of the bands 34'. The plug-supports 36' are symmetrical with the plug-supports 36, that are integral with the bar 33' and having their axes interdigited with thoses of the spear pairs 35*a'* and 35*b'*. In FIG. 5, the bands 34 and 34' are spread out and in the same plane. The spears 35*a*, 35*b*, 35*a'* and 35*b'* project toward the same side of the plane. It is the same for the plug-supports 36 and 36' and the plugs 37 and 37' which are oriented towards the same side of the plane.

In the described embodiment, it is assumed that the bands 34, 34' and the bars 32, 32', 33 and 33' are made of a material which is relatively flexible. The bands 34 and 34' are aligned with their direction making a small angle which corresponds to one half-pitch with the perpendicular to the hinge 31. The drift is one pitch when the half-shell 30 is closed onto the half-shell 29. As shown in FIG. 7, the plug-supports 36' are thus located between the plug-supports 36.

As shown in FIG. 6, the wires 38 and 38', which are to be connected, are respectively located in the corresponding grooves of the spear pairs 35*a*, 35*b* and 35*a'*, 35*b'* before the closing operation. As the wires are lying in a plane, it is possible to distinguish the even wires 38 from the odd wires 38'. Once the wires have been so inserted and correctly cut at the correct length by means of an appropriate tool, the device is folded in order to obtain the closed connector shown in FIG. 7. In this position, the spear pairs 35*a'*, 35*b'* are intercollated and hooked by their points between the spear pairs 35*a*, 35*b*, so that the connector is correctly closed.

With the aid of an appropriate tool, and when the connector has just been closed, or later on, the wires 38' may be pushed back into the plugs 37 through the slots of the plug-supports 36. On the other side of the connector, the wires 38 may be pushed back into the plugs 37' through the slots of the plug-supports 36'.

FIG. 8*b* shows how a wire 38 is first maintained between the edges 39*a* and 39*b* of a U-shaped rib having a triangular cross-section which is provided between the vertical faces and the bottom of the groove formed by the two spears 35*a* and 35*b* of a same pair. The distance between the edges 39*a* and 39*b* is smaller than the external diameter of the insulating sheath of the wire 38, but is greater than the diameter of the central conductor 40. The wire 38 is also maintained between the edges of a pinching component 41 of the plug 37'. The distance between the edges of 41 is smaller than the diameter of the insulating sheath of the wire, but greater than the diameter of the conductor 40. At last, the wire is trapped between the edges of a second pinching component 42 of the plug 37'. The distance between the edges of component 42 is smaller than the diameter of conductor 40, so that the edges bite into the copper while insuring the electrical continuity towards the end of the plug 37'.

The arrangement of the FIG. 8*b* is shown in cross-section in FIGS. 8*a*, 8*c* along the lines 8*a*—8*a* and 8*c*—8*c*, respectively, with the U-shaped outline of the ribs 39 and 39' of the plug-supports 36 and 36' pinching the wires 38 and 38'.

The FIG. 9 shows how connectors 43 of the type described with reference to the FIGS. 1–4 may be used for connecting the seven conductors of the junctions 25 to the inputs of the switching matrix blocks described in the above mentioned U.S. patent applications.

Each matrix 44 is placed between two control plates 45 and 46, one plate being assigned to the control of the crosspoints of the matrix. The other plate is assigned to the control of the crosspoints of the upper (or lower) matrix. Each connector 43 is oriented so that its plugs 6 are vertical. Connector 43 has a height which is equal to the height of the matrix 44 to which it is connected. In the free interval between two rows of connectors, i.e. on a height corresponding to the height of a control plate, horizontal cable runs 47 are mounted. The cables 25 are located in these runs. For example, each cable run has a rectangular cross-section and its upper corner is open (or the lower corner according to the orientation of the connector).

When the matrix 44 corresponds to the matrixes described in the above mentioned U.S. patent application Ser. No. 251,201, one of the two connectors is assigned to one matrix and the other to the other matrix.

The FIG. 10 shows how the connectors 48 of the type described with reference to the FIGS. 5 to 7 may be used for connecting the wires 38 and 38' to the inputs of a matrix of the type described in the above mentioned U.S. patent application Ser. No. 251,201. In this example, two superposed rows of connectors 48 are used for connecting two wire-subscriber's lines. In each connector, the plugs 37 are connected to the inputs of the first matrix while the plugs 37' are connected to the inputs of the second matrix. The cable runs are then made directly by the free space between the bands 34 and 34'. It will be noted that the bands may be replaced by solid thin plates as is schematically shown in FIG. 10.

In particular, in the case of connectors for subscriber's lines cooperating with the matrixes described in the above mentioned U.S. patent application Ser. No. 251,201, it appears clearly from FIG. 6 that the connectors made of two opened half-shells jointed by a hinge have the advantage that the wires are and remain quite visible when they are inserted and later during a checking operation, before closing the connector.

What is claimed is:

1. A coupling connector having self-stripping connection-making plugs for separately clamping insulated conductors, the connector comprising a housing with two half-shells joined by a hinge, at least one of the half-shells including a row of self-stripping plug supports, said one half-shell bearing the row of self-stripping plug supports also including a row of holes behind said self-stripping plug supports, at least the rear part of each of said self-stripping plug supports lying in a plane and having a U-shaped cross section, the other half-shell including a row of wire clamping U-shaped groove means, wherein each of the U-shaped groove means includes a pair of spears which are symmetrical with respect to the longitudinal axis of the groove means, the U-shaped groove means and the self-stripping plug supports having longitudinal axes which are parallel to each other, said U-shaped groove means having a face lying in a plane which is transverse to the U-shaped groove means, said plane of said U-shaped groove means being located behind the plane of the rear faces of the self-stripping plug supports and each wire clamping U-shaped groove means being aligned with a self-stripping plug support when the two hinged half-shells are closed one on the other, the spear pairs of the other half-shell hooking into individually associated ones of said holes when the two half-shells are closed one on the other.

2. The connector according to claim 1, wherein each half-shell has a row of self-stripping plug supports separated by free gaps which are equal to the width of each self-stripping plug support, and a row of U-shaped groove means which are respectively aligned behind said gaps so that the self-stripping plug support rows and the groove means rows of the two half-shells are imbricated when said half-shells are closed one on the other.

* * * * *